US005095696A

United States Patent [19]

Gulati et al.

[11] Patent Number: 5,095,696

[45] Date of Patent: Mar. 17, 1992

[54] ASYMMETRIC FLAMEHOLDER FOR GAS TURBINE ENGINE AFTERBURNER

[75] Inventors: Anil Gulati, Albany; Elwin C. Bigelow, Scotia, both of N.Y.

[73] Assignee: General Electric Company, Schenectady, N.Y.

[21] Appl. No.: 459,416

[22] Filed: Jan. 2, 1990

[51] Int. Cl.[5] ..... F02K 3/10

[52] U.S. Cl. ..... 60/261; 60/749

[58] Field of Search ..... 60/261, 749

[56] References Cited

U.S. PATENT DOCUMENTS

| | | | |
|---|---|---|---|
| 4,285,194 | 8/1981 | Nash | 60/261 |
| 4,802,337 | 2/1989 | Carvel | 60/749 |
| 4,815,283 | 3/1989 | Eldredge et al. | 60/261 |

*Primary Examiner*—Louis J. Casaregola
*Assistant Examiner*—Laleh Jalali
*Attorney, Agent, or Firm*—Patrick R. Scanlon; James C. Davis, Jr.; Paul R. Webb, II

[57] ABSTRACT

An afterburner flameholder for a gas turbine engine having a central diffuser cone, a generally cylindrical outer shell and fuel spray bars between the shell and cone defining an afterburner region is provided, which comprise an annular member with an asymmetric V-shaped cross section. The annular member is adapted to be secured to the engine in the afterburner region with the apex of the V facing upstream in the axial direction toward the fuel spray bars. The annular member has a first and second circular sidewall member each joined at one end forming an apex, the annular member in cross section has unequal length sidewall members. The difference in length between the distal ends of the first and second circular sidewall members is sufficient to cause spanwise vortices shed at the distal ends of the sidewall members to be out of phase when they meet downstream from the flameholder. The different lengths of the distal ends of the sidewall members results in one sidewall member extending further from the apex than the other, situating the distal ends in different planes so that spanwise vortices shed from the asymmetric sidewall members travel different path lengths and are out of phase when they meet downstream.

1 Claim, 5 Drawing Sheets

POWER SPECTRUM

ASYMMETRIC FLAMEHOLDER FOR GAS TURBINE ENGINE AFTERBURNER

BACKGROUND OF THE INVENTION

This invention relates to flame holders for use in gas turbine engine afterburners.

In military aircraft engines operating with afterburners to enhance thrust, large unsteady pressure oscillations termed screech can occur under some conditions when unsteady heat release couples with the acoustic pressure fluctuations. Screech if not suppressed, can result in instantaneous disintegration of the afterburner hardware such as flameholder, fuel injector, liner and so on. Conventionally acoustic liners are used to suppress screech. The liner has small holes which act as Helmholz resonators and absorb the energy of the unsteady pressure fluctuations. This method suffers from a number of drawbacks: (1) It is costly since the pattern of holes in the liner and their size determine the modes and frequencies of the oscillations absorbed effectively by the liner, and these modes and frequencies cannot be predicted beforehand for a new configuration; (2) the liner has to be cooled and therefore degrades the performance of the afterburner and the efficiency of the engine; and (3) the liner is ineffective at low frequencies.

Current afterburners use one or more concentric annular rings of V-shaped members, sometimes referred to as gutters or flameholders, as flame stabilizers. The flameholders are about 1½"-2" wide and are about 1½"-2" deep. The enclosed half-angle of the typical flameholder is generally about 20-24 degrees. The overall blockage to gas flow in the afterburner region offered by the flameholders is approximately 25%. The fuel is sprayed upstream of the flameholder. The flame is established at the downstream lips of the flameholder and is sustained by the recirculating products in the wake of the flameholder. The combustion takes place downstream of the flameholder and is generally unsteady. Under certain conditions the unsteady heat couples with acoustic pressure fluctuations in the afterburner cavity resulting in screech. The screech is generally at high frequencies such as 500-3000 Hz, however, sometimes lower frequency longitudinal modes (100-500 Hz.) are also observed.

The present inventors recognize that the primary mechanism responsible for screech is the interaction between the vortices (spanwise), i.e., the axes of the vortices are transverse to the flow direction, shed at the lips of the flameholder. As these vortices travel downstream they entrain hot recirculating products, pair up and couple with each other. After a time delay, depending on the fuel, velocity and so on, the vortices burn and release heat which in turn affects the dynamic pressure field in the afterburner cavity. The resulting pressure fluctuations at the lips of the flameholder create additional vortices and the process repeats. If the frequency at which this process occurs matches an acoustic mode of the device (depending on the geometry) coupling occurs and screech develops. The vortices, however, do serve the purpose of mixing the cold reactants with the hot products and are therefore vitally important in the sustenance of the flame. The flameholders are therefore essential in the afterburner. The problem is how to alleviate screech, i.e., eliminate the need for the costly acoustic liner while at the same time reducing screech to acceptable levels.

It is an object of the present invention to provide a flameholder which could replace flameholders currently used in aircraft engine afterburners and suppress combustion-induced screech.

SUMMARY OF THE INVENTION

In an embodiment of the present invention, an afterburner flameholder for a gas turbine engine having a central diffuser cone, a generally cylindrical outer shell and fuel spray means between the shell and cone defining an afterburner region is provided, which comprise an annular member with an generally asymmetric V-shaped cross section. The annular member is adapted to be secured to the engine in the afterburner region with the apex of the V facing upstream in the axial direction toward the fuel spray means. The annular member has a first and second circular sidewall member each joined at one end forming an apex, the annular member in cross section has unequal length sidewall members. The difference in length between the distal ends of the first and second circular sidewall members is sufficient to cause spanwise vortices shed at the distal ends of the sidewall members to be out of phase when they meet downstream from the flameholder. The different lengths of the distal ends of the sidewall members result in one sidewall member extending further from the apex than the other, situating the distal ends in different planes so that spanwise vortices shed from the asymmetric sidewall members travel different path lengths and are out of phase when they meet downstream.

BRIEF DESCRIPTION OF THE DRAWING

While the specification concludes with claims particularly pointing out and distinctly claiming the present invention, the objects and advantages can be more readily ascertained from the following description of a preferred embodiment when read in conjunction with the accompanying drawing in which:

DETAILED DESCRIPTION OF THE INVENTION

Figure 1:
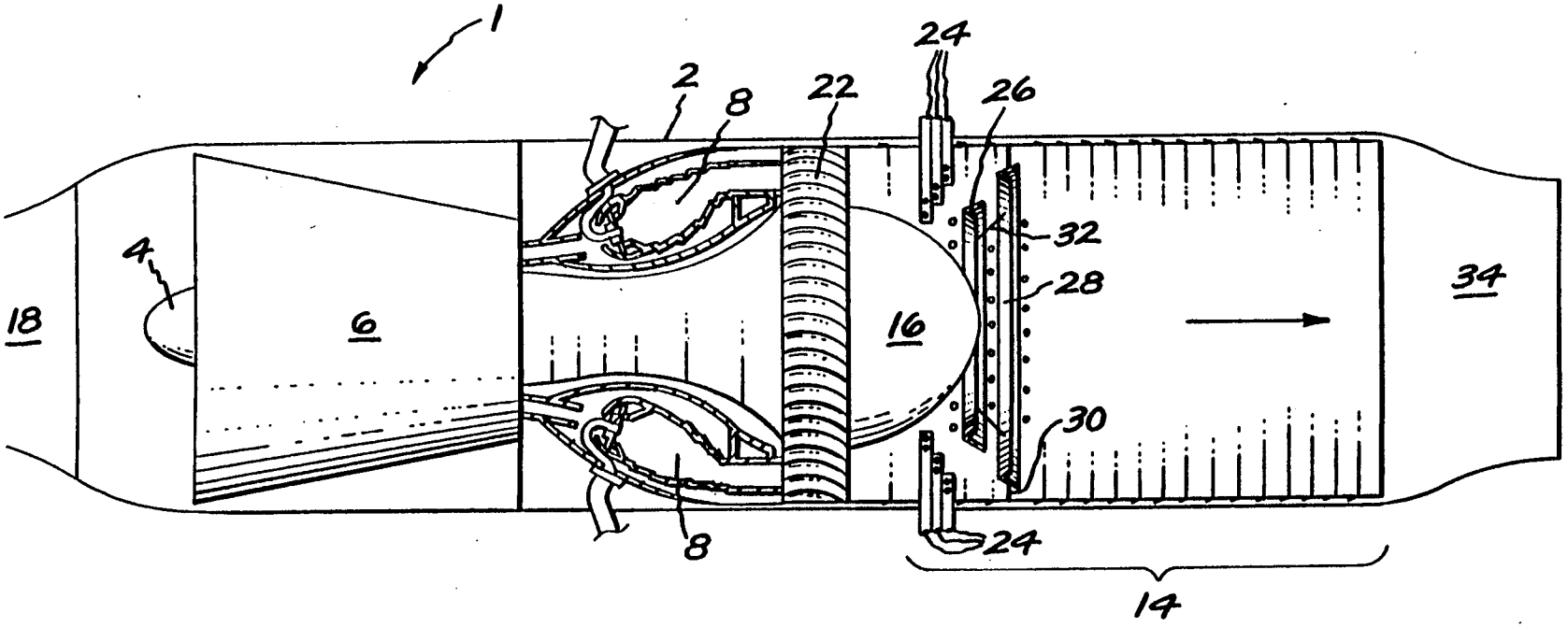
FIG. 1 is a sectional elevation view of a representative turbojet engine including an afterburner in accordance with the present invention.

In FIG. 1 a turbojet engine 1 includes a generally cylindrical outer shell 2 enclosing an inlet diffuser 4, compressor 6, annular combustion chamber 8 and an afterburner region 14. The engine 1 includes an afterburner diffuser cone 16 disposed concentrically about axis 18 of the engine. Axis 18 extends axially within the shell 2.

The engine further includes a turbine 22 situated on a common shaft with compressor 6. The turbine includes annularly disposed stationary turbine blades called nozzles and rotatable turbine blades. A plurality of radially inwardly extending fuel spray bars 24 are secured downstream from the turbine 22 and encircling the afterburner diffuser cone 16. Two annular flameholders 26 and 28 of different diameters are downstream of the fuel spray bars 24. Flameholder 26 is supported from the outer shell by supports 30. Flameholder 28 is supported from flameholder 26 by supports 32. At the outlet of the engine is an exhaust nozzle 34. Engine 1, FIG. 1, corresponds to commercially available turbojet engines such as General Electric F404 F-110 engines. Reference is made to a more detailed discussion of afterburners and aircraft gas turbine engines in a paper entitled "The Aerothermodynamics of Aircraft Gas Turbine Engines" by Gordon C. Oates, report AFAPL-TR-78-52, Wright-Patterson Air Force Base, Ohio, chapter 21, Afterburners by E. E. Zukoski, California Institute of Technology.

Figure 2:
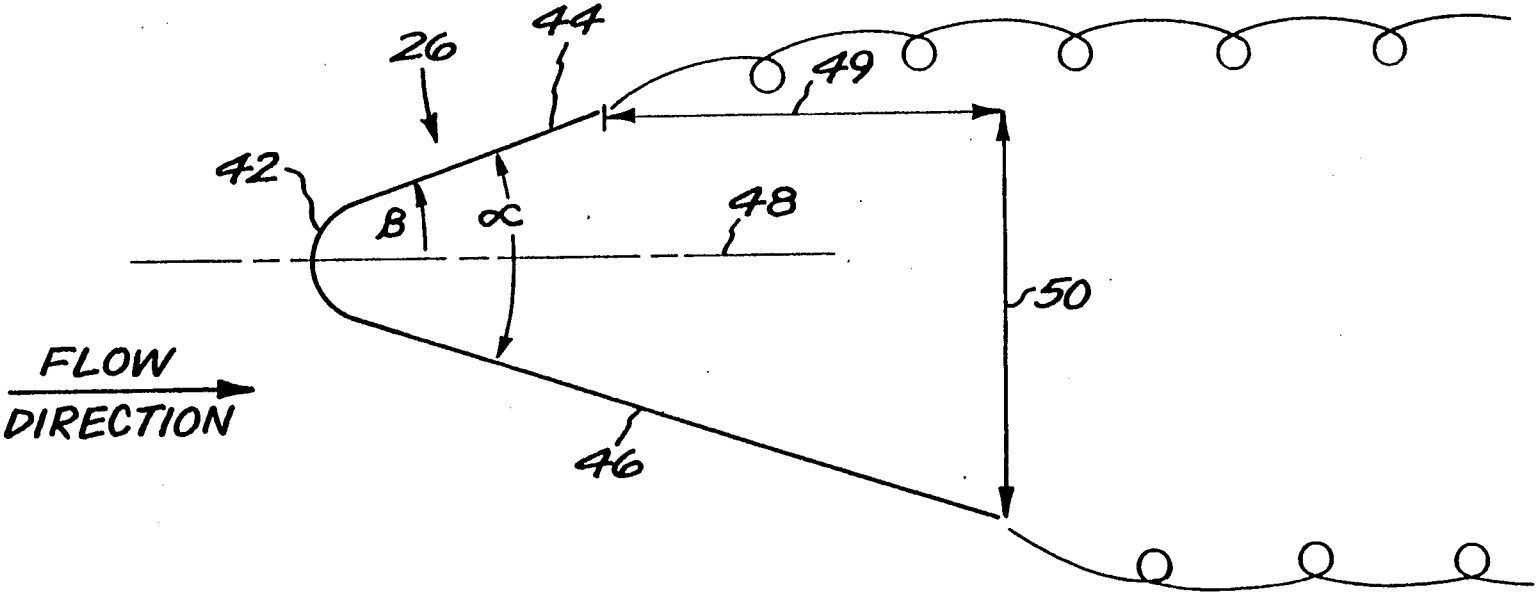
FIG. 2 shows a portion of a section of an asymmetrical flameholder taken along the lines II—II in FIG. 1.

In FIG. 2, a cross-section of a portion of asymmetric flameholders 26 is shown. Referring now to FIGS. 1 and 2 the flameholder 26 comprises an annular member having an asymmetric V-shape in cross section. The flameholder has an apex 42 which faces upstream, FIG. 1, for receiving the direct flow of gases flowing from the turbine 22, and by the radially inwardly extending fuel spray bars 24. The apex 42 is concentric with axis 18. The flameholder is formed by two flared sheet material sidewalls 44 and 46, preferably fabricated from sheet metal. The sidewalls 44 and 46 define an included angle $\alpha$ which may lie in a range of about 40°–48°. The sidewalls 44 and 46 have different lengths. The entire structure of the flameholder 26 can be formed from a single sheet material.

The inventors believe that the primary mechanism responsible for screech is the interaction between the spanwise vortices shed at the distal ends of the sidewalls of the flameholder which are also referred to as the lips of the flameholder. Spanwise vortices have central axes that are transverse to the flow direction. The spanwise vortices shown in FIG. 2 have axes extending into or out of the plane of the paper. As the spanwise vortices travel downstream, they entrain hot recirculating products, pair up and couple with each other and after a certain time delay depending on fuel, velocity and so forth, burn and release heat which in turn affects the dynamic pressure field in the interior of the afterburner. The resulting pressure fluctuations at the distal ends of the V-gutter lead to another set of vortices and thus the process is repeated. If the frequency at which this process occur matches an acoustical mode of the afterburner, coupling occurs and screech develops. The vortices shed by the distal ends of the sidewalls of the flameholder lips serve the purpose of mixing cold reactants with the hot products and are therefore vitally important to the sustenance of the flame.

The flameholder of the present invention introduces a phase-shift between the set of spanwise vortices being shed from the distal ends of the sidewalls of the flameholder by having the sidewalls of the flameholder be different lengths with one sidewall having a reduced length and the other having a length which is increased by the same amount the other sidewall was reduced. This asymmetric arrangement results in the two distal ends of the flameholder being in different planes transverse to the the flow and hence the spanwise vortices shed by the flameholder travel different path lengths and thus being out of phase when they meet downstream. The growth rates of these vortices would also be correspondingly different when measured from a common point unlike the situations with a symmetric flameholder. The asymmetric flameholder would thus decouple the two sets of spanwise vortices, prevent their coalescence and is thus expected to result in much lower levels of unsteady pressure oscillations. The enclosed half-angle $\beta$ defined as the angle between a bisector 48 of the enclosed angle and either of the sidewalls and the overall blockage of the asymmetric flameholder is maintained the same as that of a conventional flameholder and hence the symmetric and asymmetric flameholders are expected to possess similar flame spreading properties and stability limits. Blockage is the percent of the overall afterburner which is obstructed perpendicular to the flow direction.

A low L/D large scale combustor (6"×6") cross section was built to simulate afterburner operation in the screech mode. Gaseous fuel and heated air were supplied to the combustor. Two flameholders, one symmetric and one asymmetric were built with identical enclosed half-angle of 22 degrees and the same overall blockage of 33%. The difference in length between the longer and shorter sidewalls measured horizontally 49 (parallel to the included angle bisector of the V-gutter) is approximately the same distance as the V-gutter width 50 measured in a plane perpendicular to the flow. In simulation tests, a horizontal distance of 1" with a V gutter width of 1¼" was found to give the best performance.

Figure 3A:
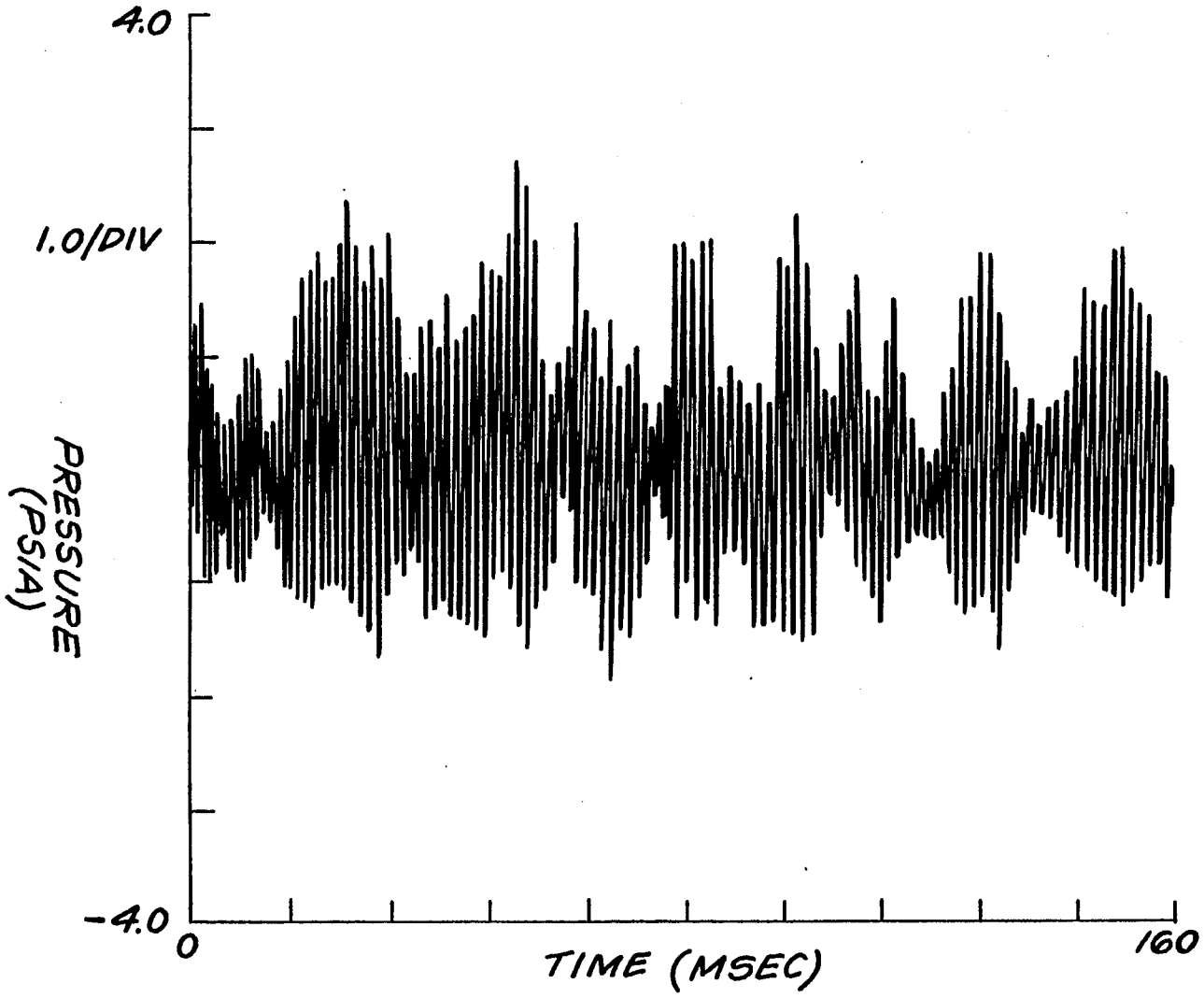
FIGS. 3A and 3B are graphs showing the dynamic pressure traces in psia as a function of time for a symmetric and asymmetric flameholder respectively measured in an afterburner simulator.
Figure 3B:
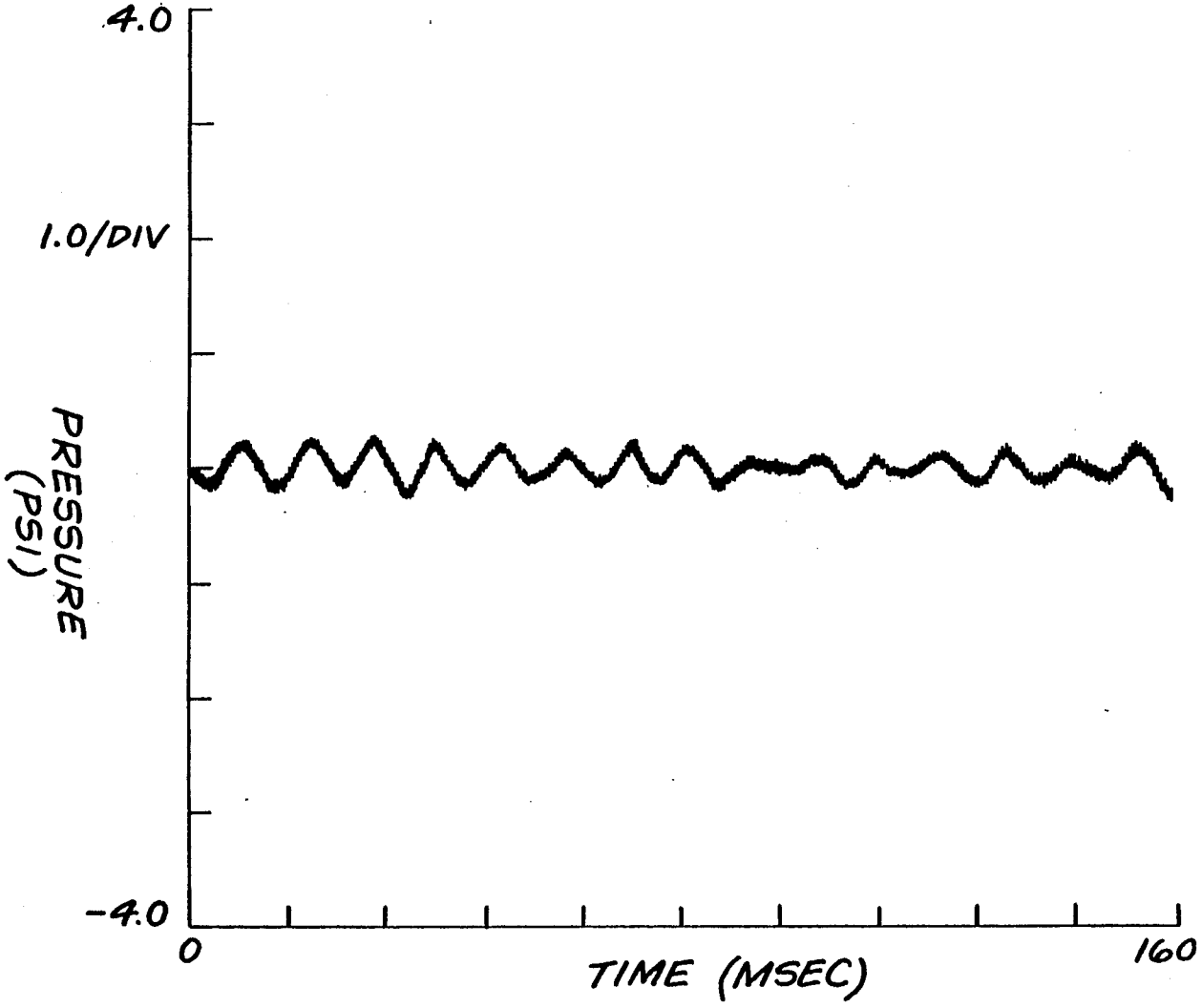

FIGS. 3 A and B show the dynamic pressure trace measured with the symmetric and asymmetric flameholders at an upstream inlet velocity of 50 fps and an equivalence ratio of 0.9. The trace from the conventional V-gutters (FIG. 3A) shows large scale high frequency oscillations with peak-to-peak pressure oscillation of up to 4 psia whereas the trace obtained when the asymmetric flameholder of the present invention is used FIG. 3B shows much reduced low frequency dynamic activity with peak-to-peak oscillations of less than 0.5 psia.

Figure 4:
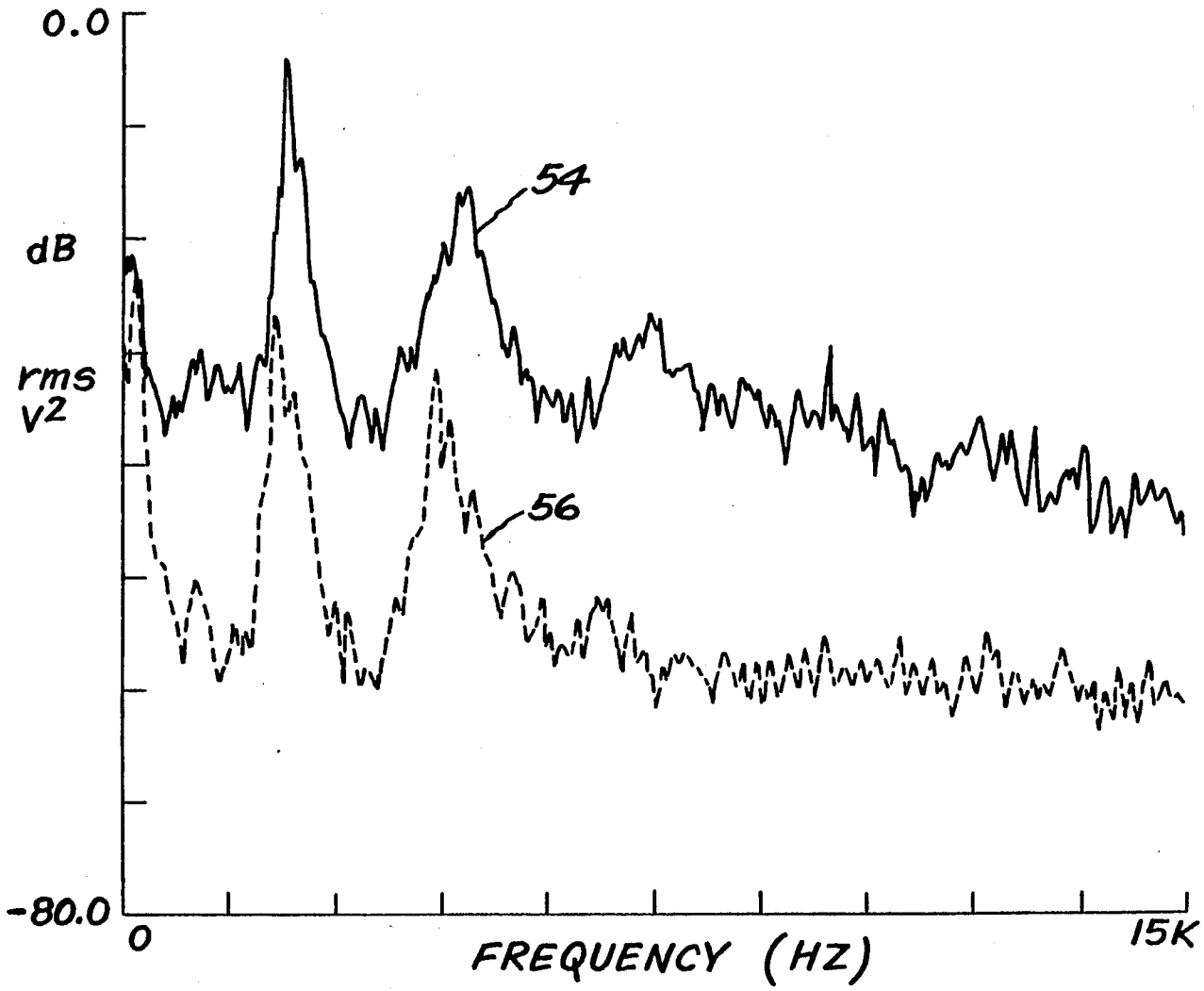
FIG. 4 shows the power spectra obtained from the dynamic pressure traces shown in FIG. 3 as a function of frequency for the symmetric and asymmetric flameholders, respectively.

FIG. 4 shows the corresponding measured power spectra with the symmetric and asymmetric flameholders, respectively. The conventional flameholder indicated by reference numeral 54 has a large peak at approximately 2,500 Hz whereas the asymmetric flameholder indicated by reference numeral 56 shows a much reduced activity lower by 23 dB at the high frequency and a similar much reduced activity at approximately 5000 Hz corresponding to the second harmonic mode. The overall sound-pressure level at the measurement location is reduced by approximately 16 dB from 95 dB with the conventional V-gutter to 79 dB with the new design. Similar encouraging results were obtained at other equivalence ratios and with the flameholders mounted vertically rather than horizontally in the tunnel. No significant change in the flame stability was observed.

The foregoing has described a new flameholder which can replace flameholders currently used in aircraft engine afterburners and suppress combustion-induced screech.

While the invention has been described with respect to a preferred embodiment thereof, it will be understood by those skilled in the art that various changes in form and detail may be made without departing from the spirit and scope of the invention.

What we claim is:

1. An afterburner flameholder for a gas turbine engine, said engine having an afterburner region including a central diffuser cone, a generally cylindrical outer shell and fuel spray means in the region between the shell and the cone, said flameholder comprising:

an annular member having an asymmetric V-shape in cross section, said annular member including a first and a second circular sidewall member, each sidewall member being joined together at one end forming an apex, said annular member adapted to be secured to the engine in the afterburner region with the apex facing upstream in an axial direction towards the fuel spray means, the annular member in cross section forming a V with unequal length sidewall members, the distance between the distal ends of the first and second circular members measured in the direction of the included angle bisector being approximately equal to the distance between the distal ends measured in a direction perpendicular to the bisector.

* * * * *